United States Patent [19]

Ozeki

[11] Patent Number: 5,037,137

[45] Date of Patent: Aug. 6, 1991

[54] FILING BINDER

[75] Inventor: Jiro Ozeki, Tokyo, Japan

[73] Assignee: Slidex Corporation, Japan

[21] Appl. No.: 545,274

[22] Filed: Jun. 28, 1990

[30] Foreign Application Priority Data

Sep. 26, 1989 [JP] Japan ..... 1-249730
Jan. 25, 1990 [JP] Japan ..... 2-15371

[51] Int. Cl.[5] ..... B42D 17/00

[52] U.S. Cl. ..... 281/48; 40/159.2; 40/530

[58] Field of Search ..... 281/48, 45, 28, 15.1; 40/530, 158.1, 159.2, 394, 395; 402/80 R, 80 P

[56] References Cited

U.S. PATENT DOCUMENTS

| | | | |
|---|---|---|---|
| 1,253,435 | 1/1918 | Simpson | 281/48 |
| 3,956,836 | 5/1976 | Seaborn | 40/530 |
| 4,141,162 | 2/1979 | Mascolo | 40/158.1 |
| 4,193,218 | 3/1980 | Mermelstein | 40/159.2 |
| 4,521,035 | 6/1985 | Berezowsky | 40/530 |
| 4,524,991 | 6/1985 | Thomas . | |
| 4,575,123 | 3/1986 | Giblin et al. | 281/48 |
| 4,596,613 | 2/1986 | Thomas | 402/80 R |
| 4,614,360 | 9/1986 | Sheehan | 281/45 |
| 4,682,792 | 7/1987 | Simmons | 281/45 |
| 4,949,997 | 8/1990 | Champagne | 281/42 |

FOREIGN PATENT DOCUMENTS

| | | | |
|---|---|---|---|
| 907411 | 3/1954 | Fed. Rep. of Germany . | |
| 2206240 | 8/1973 | Fed. Rep. of Germany | 281/17 |
| 2318394 | 11/1973 | Fed. Rep. of Germany . | |
| 2614840 | 5/1987 | France . | |

*Primary Examiner*—Frank T. Yost
*Assistant Examiner*—Hwei-Siu Payer
*Attorney, Agent, or Firm*—Michael O. Warnecke

[57] ABSTRACT

A filing binder comprises a plurality of elongated binding members made of a resilient material. Each of the binding members has a groove extending along the length of the binding member and formed with a slit opening opened at one side of the binding member. The groove is of a cross-sectional configuration which is enlarged from the slit opening toward transverse inward direction. The binding members are arranged in side-by-side relationship with the slit openings directed to the same orientation and connected together by flexible or hinge connection.

7 Claims, 8 Drawing Sheets

FILING BINDER

BACKGROUND OF THE INVENTION

1. Field of the Invention

The present invention relates to a file device and binders to be used for such file device. More particularly, the present invention pertains to a file device for filing thin sheets of recording medium, such as photographic pictures, slides, medical specimen plates, floppy discs and the like. The present invention further pertains to components to be used in such file device.

2. Description of the Prior Art

The Japanese patent application Sho 63-241935 filed on Sept. 27, 1988 and disclosed for public inspection on Mar. 29, 1990 under the disclosure number Hei-02-089699 discloses a file sheet adapted for filing thin recording sheets such as photographic slides. The file sheet is made of a thin plastic sheet formed with recesses adapted for receiving the slides. A plurality of such file sheets are bound in suitable binding covers with photographic slides fitted to the recesses of the sheets or that the slides are filed in a readily accessible manner.

In binding such file sheets, file covers having binding rings provided at appropriate spacings may be used. The file sheets may then be formed along an edge portion with binding holes with spacings equal to the spacings of the binding rings so that the binding rings are fitted to the binding holes in the file sheets. This type of file sheet binding device is advantageous in that the file sheets can be added as desired. It should however be noted that in order to bind an additional file sheet the rings are at first opened and the file sheet is engaged at the binding holes with the rings thus opened. Thereafter, the rings are closed to hold the file sheet together with previously bound file sheets. Thus, binding an additional file sheet requires a troublesome task.

Another problem encountered in the aforementioned sheet binding device is that turning over the file sheets is not convenient. More specifically, in this type of binding device, the binding rings are generally of a large size so that a large number of file sheets can be accommodated. The binding rings of such large size have a tendency of making turning over the file sheets difficult because the file sheet may have a tendency of sticking to the binding rings by being inclined with respect to the row of the binding rings.

SUMMARY OF THE INVENTION

It is therefore an object of the present invention to provide a filing device for file sheets in which binding of the file sheets can readily be made so that additional file sheets can be easily filed.

Another object of the present invention is to provide a file device for file sheets which is simple in structure and convenient to use.

A further object of the present invention is to provide a file device which is convenient to change the binding capacity.

Still further object of the present invention is to provide a file device which is compact in size.

According to the present invention, the above and other objects can be accomplished by a filing binder comprising a plurality of elongated binding members made of a resilient material, each of said binding members having a groove extending along the length of the binding member and formed with a slit opening opened at one side, said groove being of a cross-sectional configuration which is enlarged from said slit opening toward transverse inward direction, said binding members being arranged in side-by-side relationship with said slit openings directed to the same orientation and connected together by flexible connecting means.

According to another aspect of the present invention, there is provided a file sheet having ridge means formed along one edge portion thereof. The file sheet can be filed in filing binder by having the ridge means engaged with the groove of the binding member of the filing binder.

The binding member may be made of a rigid plastic material and the connecting means may be a weld between adjacent two binding members. The binding member may be formed with the groove having slit openings at the opposite sides. The connecting means may then be one or more connecting members having projections arranged in side-by-side relationship, each of said projections being adapted to be engaged with one of the slit openings in each of the adjacent binding members.

According to another aspect of the present invention, the binding member has a pair of opposed pawls forming a slit opening therebetween. A plurality of such binding members being arranged in side-by-side relationship with the slit openings oriented in the same direction.

According to a further aspect of the present invention, there is also provided a binding member including a plurality sets of holding means each comprising a wall and a holding member made of a resilient material, said holding member having pawl means directed toward the wall to hold a file sheet between said wall and said pawl means, the plurality sets of holding means being connected by resilient connecting means.

The binder comprising the binding members which are connected together as described above may be provided with cover sheets so that the file sheets bound in the binder are covered by the cover sheets.

According to a further aspect of the present invention, there are provided a plurality of connecting members each comprising a pair of binding members of the aforementioned structure. The pair of binding members in each connecting member are connected together with the slit openings oriented in the same direction. There are also provided a plurality of file sheets each having ridge means along each one of opposed sides for engagement with the groove of the binding member. The file sheet is bound to one of the connecting member by having the ridge means at one side engaged with the groove in one binding member of said one connecting member. Further, the same file sheet is connected with another connecting member by having the ridge means at the other side engaged with the groove in one binding member in said another connecting member. The other binding member in the first mentioned connecting member is connected to a further file sheet by having the ridge means in the further file sheet at one side engaged with the groove of the said other binding member. The other binding member of the second mentioned connecting member is also connected with a further file sheet in a similar manner. In this manner, a plurality of file sheets are foldably connected by a plurality of connecting members.

According to a further aspect of the present invention, a plurality of binding members are connected together at the sides opposite to the grooves in a manner that a hinge movement is allowed between two adjacent binding members. A spine or shelf back is attached to the outside of the connected sides of the binding members and cover sheets are provided at the opposite sides of the spine in a manner that the cover sheets can be opened outwardly. Each of the cover sheets is provided with means for engagement with the groove of the binding member and the cover sheet is connected with the outermost binding member by having the engagement means engaged with the groove of the outermost binding member.

As described, the present invention provides a binding member which is of an elongated configuration and has a longitudinally extending groove formed with a slit opening opening at one side of the binding member. It will therefore be understood that the file sheet can be held in position simply by having one edge portion engaged with the slit opening of the binding member. The binding members may be connected together with the slit openings oriented to the same direction. In binding the file sheets, it is only required to have one edge portion of each file sheet inserted into the slit opening of the binding member. Thus, binding of the file sheets can be effected through a simple operation. The connecting member for connecting a plurality of the aforementioned binding members can conveniently be used and the binding members can be added as desired depending on the size of the connecting member.

The connecting member comprising a pair of binding members as previously mentioned can be advantageously used because it is possible to bind a desired number of file sheets without being restricted by the size of the connecting member. It should further be noted that the file sheets bound by this connecting member can be accessed very easily.

The above and other objects and features of the present invention will become apparent from the following descriptions of preferred embodiments taking reference to the accompanying drawings.

DESCRIPTION OF THE PREFERRED EMBODIMENT

Figure 1:
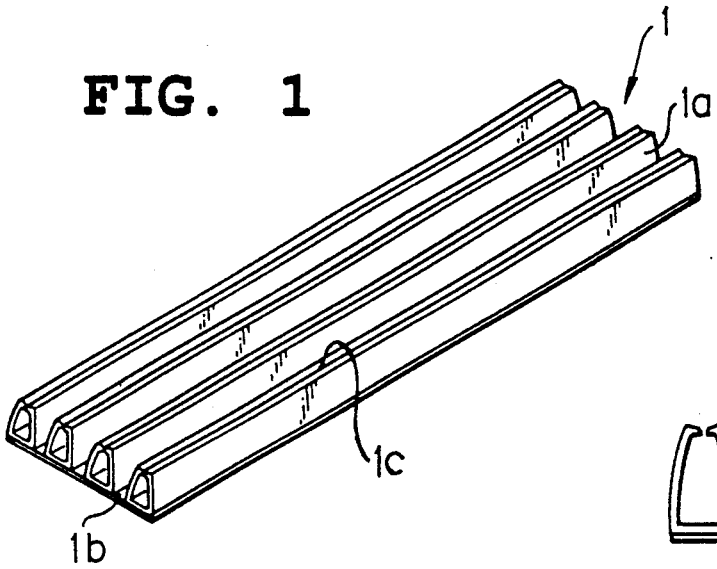
FIG. 1 is a perspective view of a file sheet binder in accordance with one embodiment of the present invention.

Referring to the drawings, particularly to FIGS. 1 through 5 which show a first embodiment of the present invention, it will be noted that there is shown a binder 1 comprising a plurality of binding members 1*a*. The binding member 1*a* is made of an extrusion of a solid or hard plastic material and includes a groove 1*d* having a slit opening 1*c* extending along one side of the binding member 1*a*. The groove 1*d* is of a cross-sectional configuration enlarged widthwise toward transversely inward direction. In the illustrated embodiment, four binding members 1*a* are arranged in a side-by-side relationship with the slit openings 1*c* oriented in the same direction. The binding members 1*a* are arranged with spacings corresponding to the thickness of a file sheet to be bound. These binding members 1*a* are connected together at the sides opposite to the slit openings 1*c* by means of a plastic tape 1*b* which is welded to the binding members. The plastic tape 1*b* provides a flexible connection between the binding members 1*a*.

Figure 2:
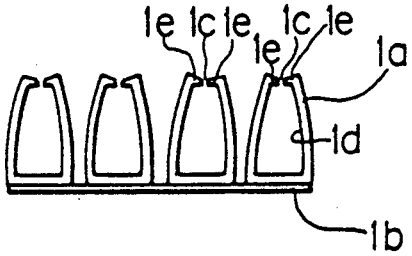
FIG. 2 is a view as seen from one end of the binder shown in FIG. 1.

In FIG. 2, it will be noted that the binding member 1*a* is formed at the slit opening 1*c* with a pair of opposed inwardly projecting edges or pawls 1*e*. The slit opening 1*c* is defined between the opposed pair of pawls 1*e*. The pawls 1*e* have outer surfaces which are inclined transversely inwardly to provide guide surfaces for insertion of a file sheet. This guide surface makes it convenient to insert the file sheet into the groove l*d*.

Figure 3:
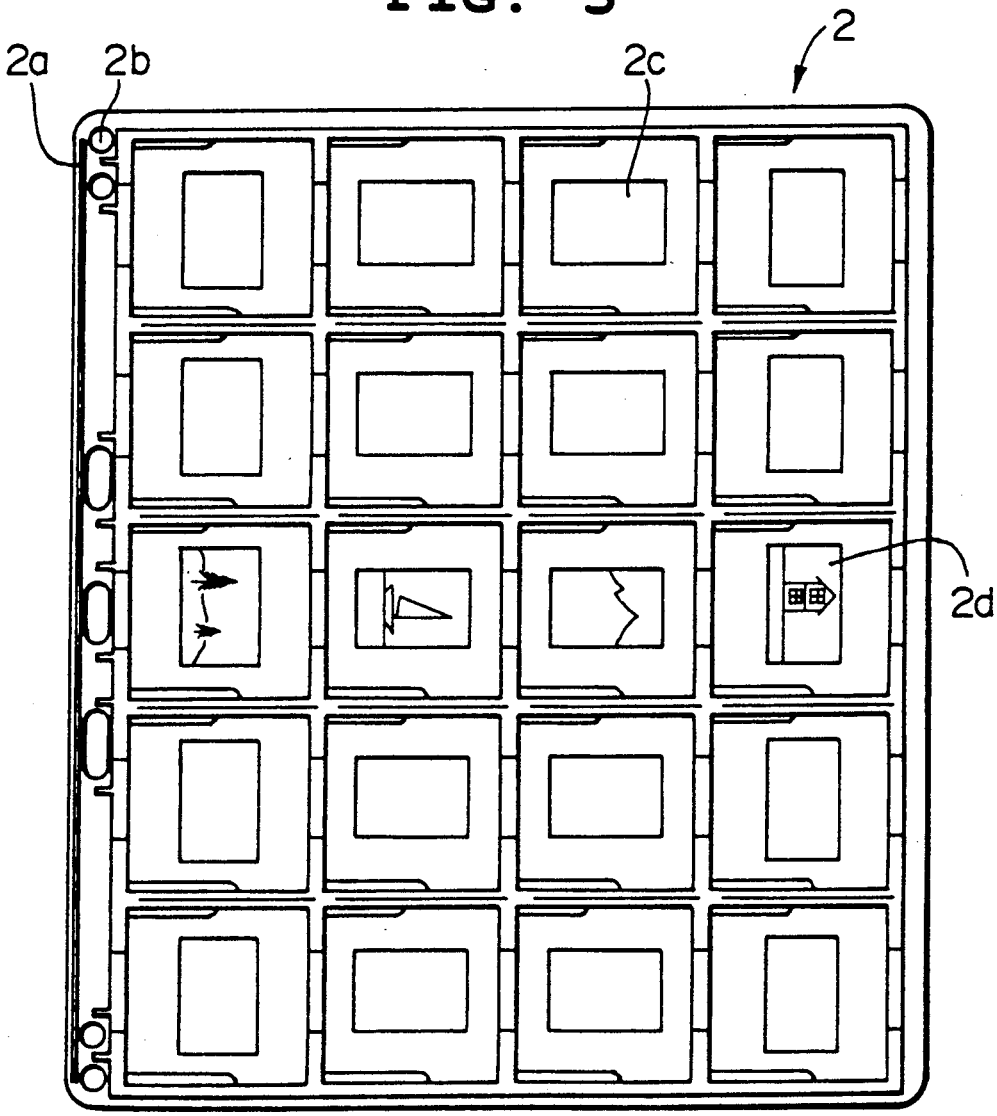
FIG. 3 is a plan view of a file sheet which can be used with the binder shown in FIGS. 1 and 2.
Figure 4:
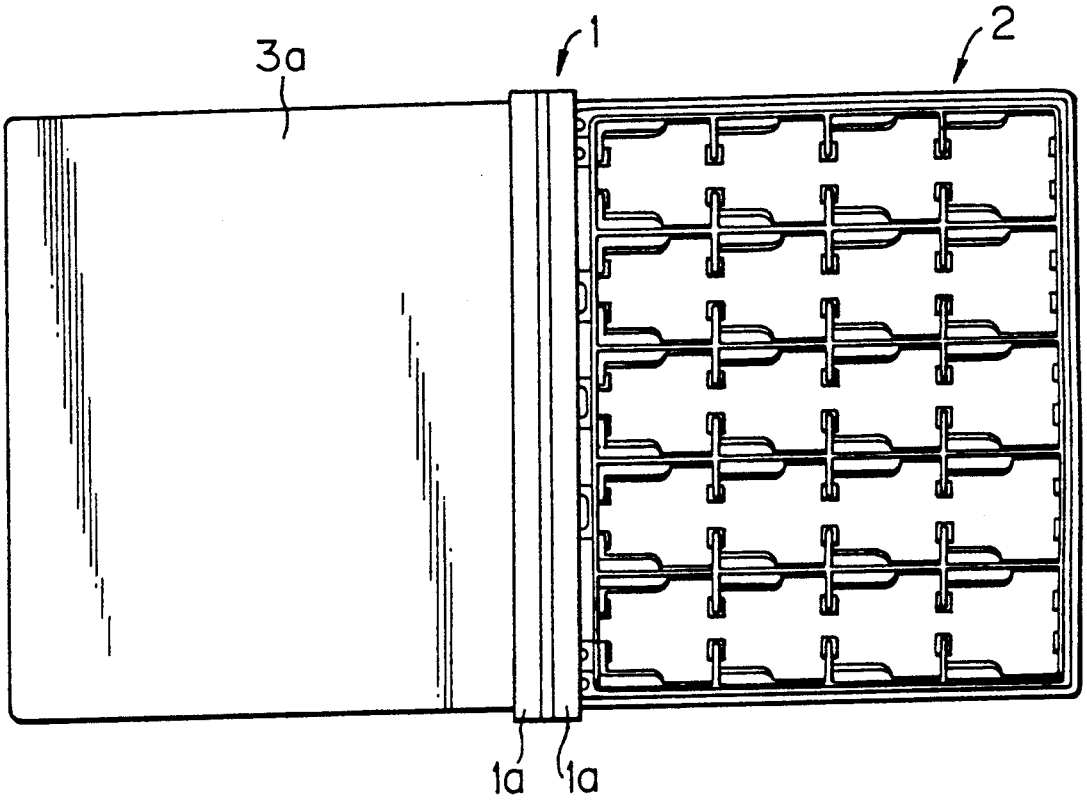
FIG. 4 is a plan view of a file sheet bound in the binder.
Figure 5:
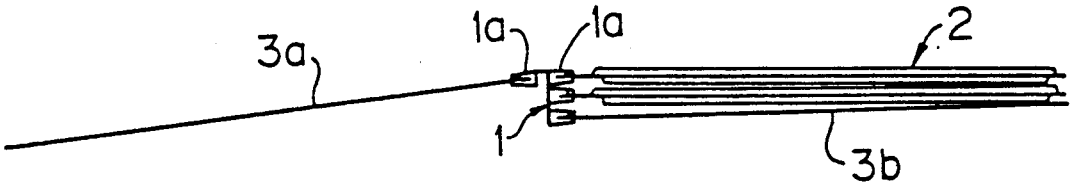
FIG. 5 is an end view showing file sheets bound in the binder.
Figure 6:
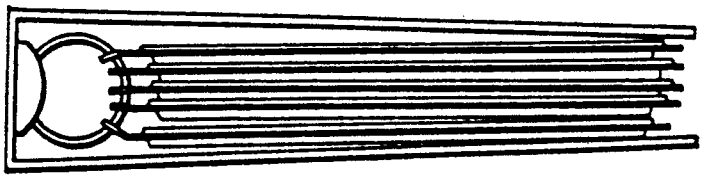
FIG. 6 (PRIOR ART)
FIG. 6 is an end view showing an example of a conventional binder.

FIG. 3 shows an example of the file sheet 2. In this example, the file sheet 2 has a plurality of sections 2*c* for accommodating photographic slides 2*d*. Along one edge portion of the file sheet 2, there are formed a plurality of binding holes 2*b* which are used for engagement with binding rings in a conventional binder which is shown in FIG. 6. Adjacent to the row of the binding holes 2*b*, the file sheet 2 is formed with a ridge 2*a* extending along the aforementioned edge portion of the file sheet 2. In this example, the ridge 2*a* is of a single continuous structure, however, a plurality of ridges may be formed to extend in a single row. The file sheet 2 shown in FIG. 3 can be held in position in the binder 1 by having the ridge 2*a* engaged with the groove 1*d* of the binding member 1*a*. In this position, the ridge 2*a* is engaged with the inner face of one of the pawl 1*e* forming the slit opening 1*c*. FIGS. 4 and 5 shows the file sheets 2 held in the binder 1.

Referring to FIGS. 4 and 5, cover sheets 3*a* and 3*b* are engaged with the outermost ones of the binding members 1*a* of the binder 1 and the file sheets 2 are held by intermediate ones of the binding members 1*a*. The cover sheets 3*a* and 3*b* may not be necessary. The number of the binding members 1*a* can be increased as desired. For example, two binders 1 having four binding members 1*a* may be connected together by means of an adhesive tape. Alternatively, the number of the binding members 1*a* may be determined as desired when they are welded together by the plastic tape 1*b*.

Figure 7:
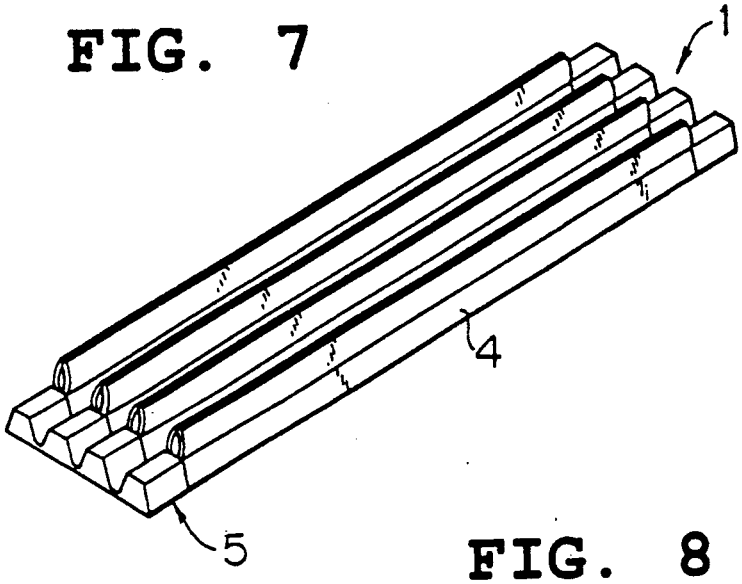
FIG. 7 is a perspective view of a binder in accordance with another embodiment of the present invention.
Figure 8:
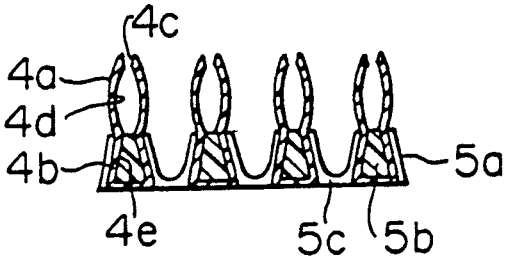
FIG. 8 is a cross-sectional view of the binder shown in FIG. 7.
Figure 9:
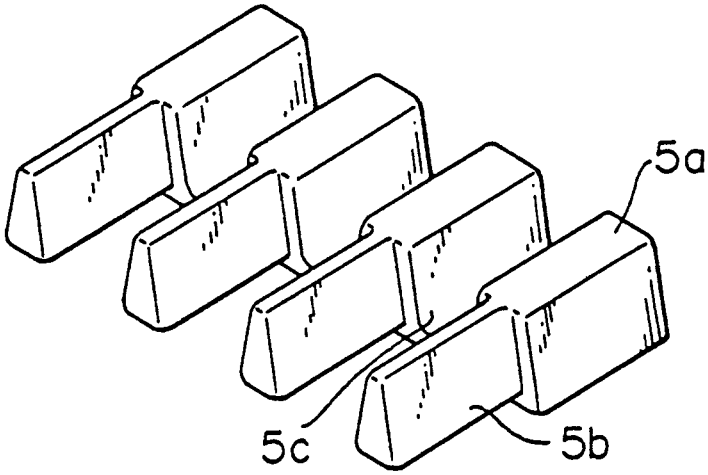
FIG. 9 is a perspective view of a connecting member which is used in the binder shown in FIG. 7.

Referring now to FIGS. 7 to 9, there is shown another embodiment of the present invention. In this embodiment, the binder includes a plurality of binding members 4 which are made of extrusions of a solid plastic material. The binding member 4 includes a pair of opposed binding sections 4*a* of annular shape and a base portion 4*b* continuous with the binding sections 4*a*. The binding sections 4*a* are arranged to define a groove 4*d* having a slit opening 4*c*. The groove 4*d* is of a cross-sectional configuration enlarged toward transverse inward direction from the slit opening 4*c*. The slit opening 4*c* is defined by edges of the opposed binding sections 4*a*. In the base portion 4*b*, there is formed a groove 4*e* of a trapezoidal cross-sectional configuration.

The binding members 4 are connected together by means of connecting members 5. The connecting member 5 includes a plurality of bodies 5*a* and projections 5*b* extending from respective ones of the bodies 5*a*. The bodies 5*a* and the projections 5*b* are made integrally from a plastic material. The projection 5*b* has a cross-sectional configuration corresponding to the cross-sectional configuration of the groove 4*e* of the binding member 4. As shown in FIG. 8, the bodies 5*a* are connected together by means of flexible connecting bands 5*c*. The binding members 4 are connected together by the connecting member 5 by having the projections 5*b* of the connecting member 5 engaged with the grooves 4*d* of the binding members 4. As shown in FIG. 7, the binding members 4 are connected together at the opposite end portions by two connecting members 5.

Figure 10:
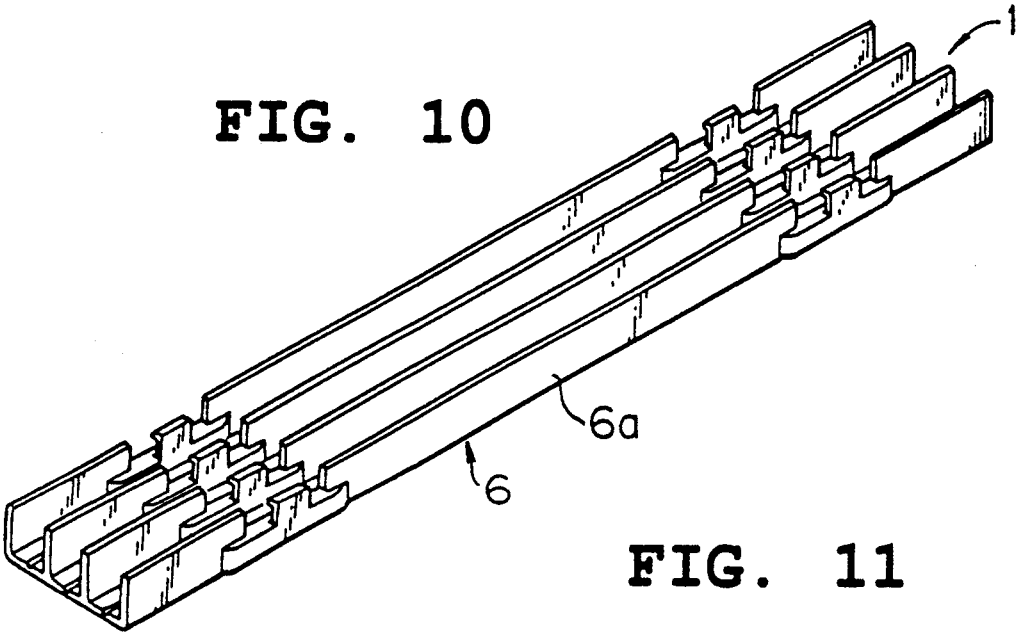
FIG. 10 is a perspective view of a binder in accordance with a further embodiment of the present invention.
Figure 11:
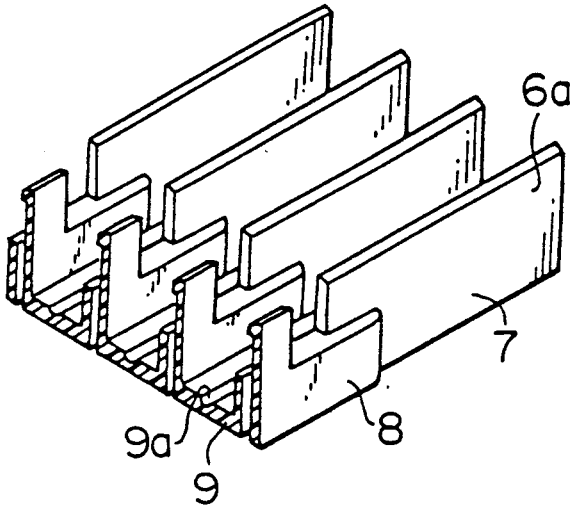
FIG. 11 is a perspective view showing a portion of the binder shown in FIG. 10.
Figure 12:
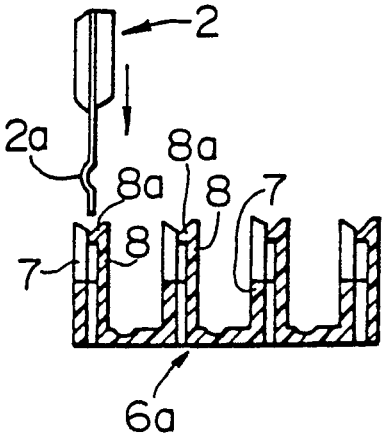
FIG. 12 is a sectional view showing the manner of use of the binder shown in FIG. 10.

FIGS. 10 through 12 show a further embodiment of the present invention. In this embodiment, the binder 6 is constituted by a plurality of binding members 6*a* which are connected together. Each of the binding members 6*a* includes a wall 7 and a binding section 8 provided at a sidewardly offset position with respect to the wall 7. The wall 7 and the binding section 8 are connected together by a base 9 as shown in FIG. 11. The base 9 is formed with a groove 9*a* which provides a flexibility to the base 9. The binding section 8 has a pawl 8*a* which is directed opposite to the wall 7. The binding members 6*a* are connected together by welding the bottom portion of the binding section 8 to the wall 7 of the adjacent binding member 6 with the pawl 8*a* of the binding section 8 directed to the wall 7 of the adjacent binding member 6*a*. As shown in FIG. 12, a file sheet 2 having a ridge 2*a* at one edge portion is inserted between the wall 7 of one binding member 6*a* and the binding section 8 of the adjacent binding member 6*a*. The ridge 2*a* of the file sheet 2 is then gripped in position by the pawl 8*a* of the binding section 8.

Figure 13:
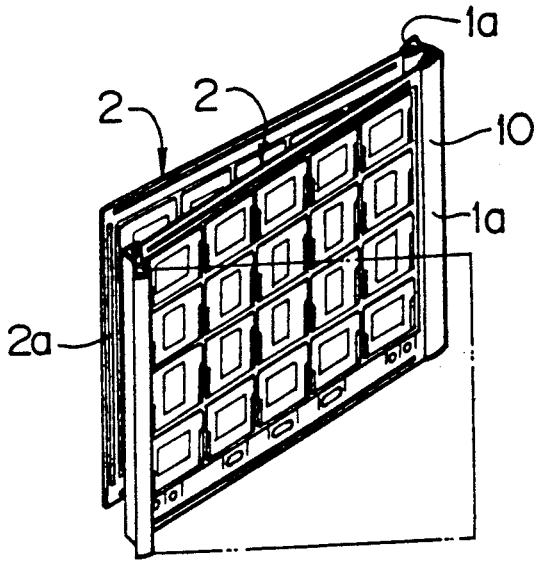
FIGS. 13 and 14 are perspective views showing in different angles a binder in accordance with a further embodiment of the present invention.
Figure 14:
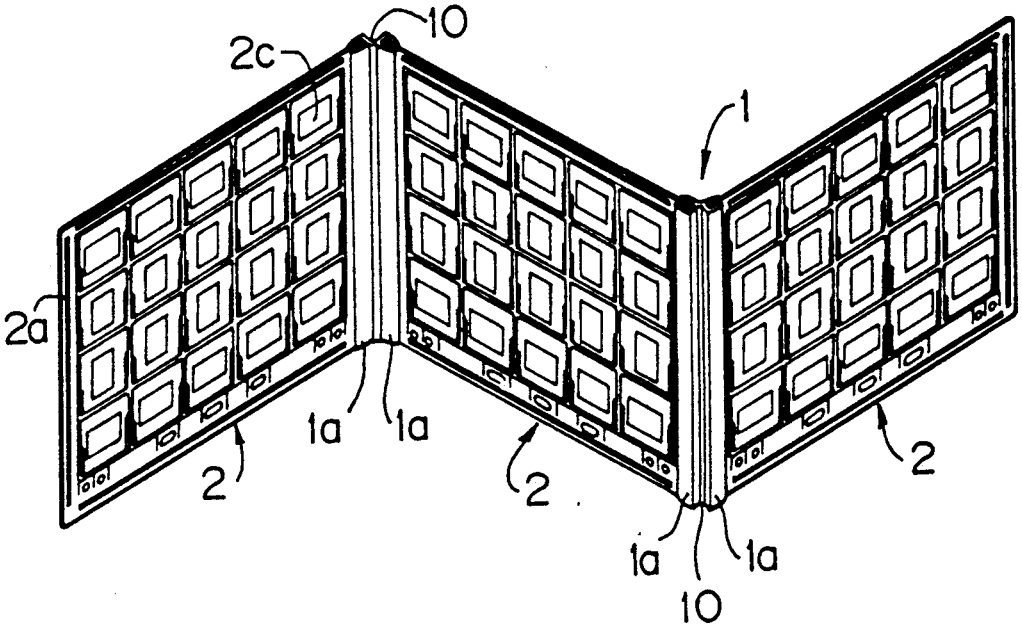

Referring now to FIGS. 13 and 14, there is shown a further embodiment of the present invention. This embodiment includes a plurality of connecting members 10 each comprising a pair of binding members 1*a* shown in FIGS. 1 and 2. The binding members 6*a* are connected together with the slit opening 1*c* directed in the same direction. File sheets 2 which may be of a shape as shown in FIG. 3 but has a pair of ridges 2*a* provided to extend along the opposite sides of the file sheet 2.

The file sheet 2 is connected with the connecting member 10 by having the ridge 2*a* at one edge of the file sheet 2 engaged with the groove of one of the binding members 1*a* in the connecting member 10. Another file sheet 2 is connected with the same connecting member 10 by having the ridge 2*a* of this file sheet 2 engaged with the groove of the other binding member 1*a* of the same connecting member 10 as shown in FIG. 13. A second connecting member 10 is provided and connected with one of the aforementioned two file sheets 2 by having the ridge 2*a* of this file sheet 2 engaged with the groove of one of the binding members 1*a* of the second connecting member 10. A further file sheet 2 is connected with this second connecting member 10 in the same manner as shown in FIG. 14. By repeating this procedure, it is possible to connect a desired number of file sheets 2. It should further be noted that the file sheets 2 thus connected can be folded one over the other at the connecting members 10. The file sheets 2 connected in this manner are readily accessible.

Figure 15:
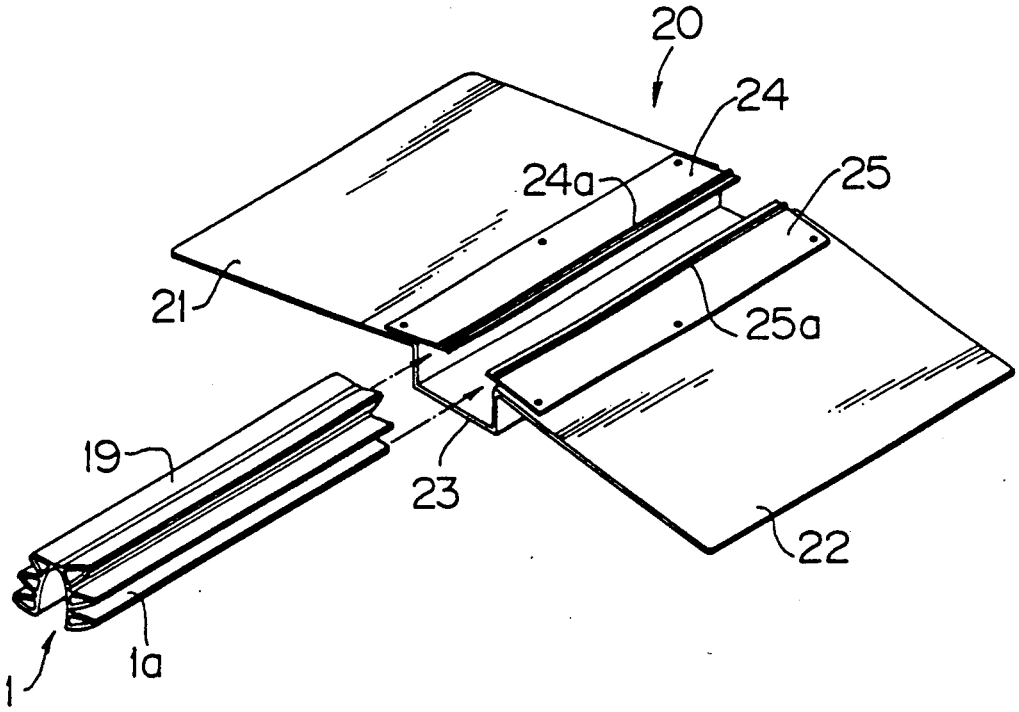
FIG. 15 is an exploded perspective view showing a further embodiment of the present invention.
Figure 16:
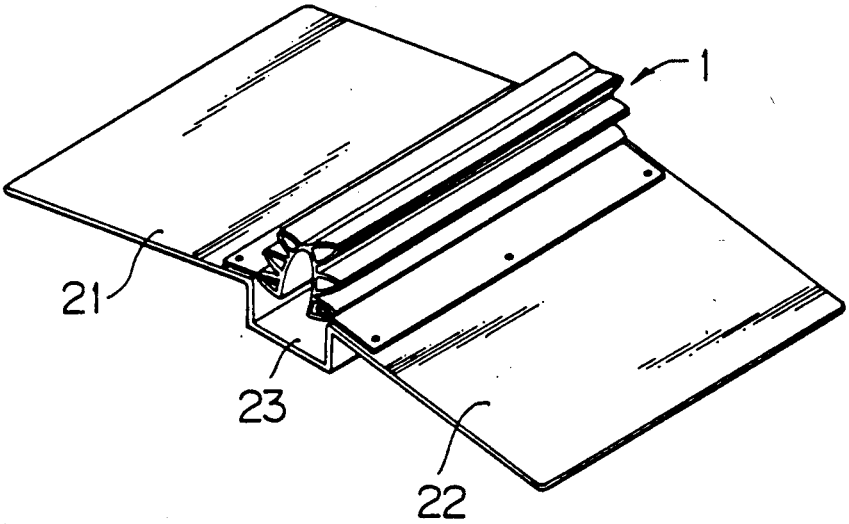
FIG. 16 is a perspective view of the binder shown in an assembled condition.
Figure 17:
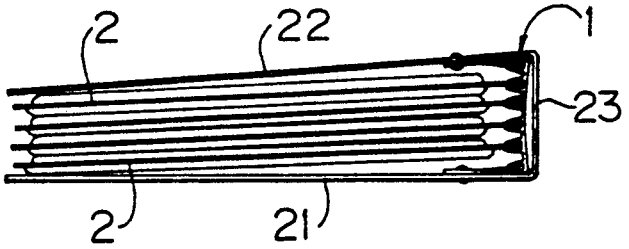
FIG. 17 is an end view of the binder shown in FIGS. 15 and 16 with file sheets filed in the binder.
Figure 18:
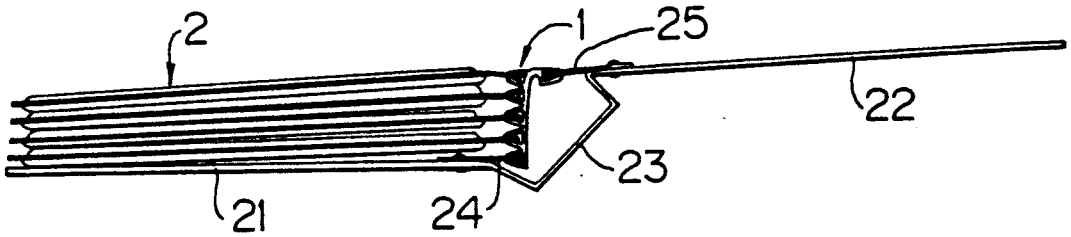
FIG. 18 is an end view showing the binder of FIG. 17 with one of the cover sheets opened.

FIGS. 15 through 19 show a further embodiment of the present invention. This embodiment utilizes the binder 1 comprising a plurality of the aforementioned binding members 1*a* as shown in FIGS. 1 and 2. This embodiment further includes a cover 20 comprising a pair of cover sheets 21 and 22 and a spine or binding 23. The spine 23 is of a channel shaped cross-sectional configuration having a pair of side edges. The cover sheet 3*a* and 3*b* are connected through hinge connections with respective edges of the spine 23 so that the cover sheets 3*a* and 3*b* can be moved between an open position as shown in FIGS. 15 and 16 and a closed position as shown in FIG. 17.

The cover sheets 3*a* and 3*b* are provided at the back sides adjacent to the hinge connections to the spine 23 with connecting plates 24 and 25 which are arranged to project into the confine of the channel shaped spine 23. The connecting plates 24 and 25 are formed at the portions projecting into the confine of the spine 23 with ridges 24*a* and 25*a*, respectively.

Figure 19:
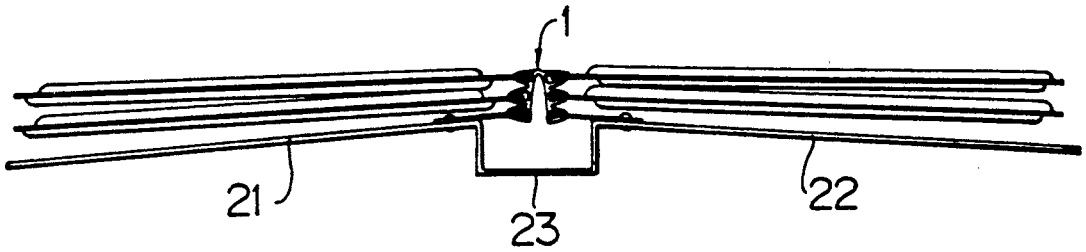
FIG. 19 is an end view similar to FIG. 18 but showing the binder with the file sheets in opened positions.

The binder 1 is attached to the cover 20 by having the outward ones of the binding members 1*a* engaged with the edges of the connecting plates 24 and 25 as shown in FIG. 16. The file sheets 2 are attached to the intermediate ones of the binding members 1*a* as shown in FIG. 17. FIG. 17 shows the cover 20 in the closed position in which the binder 1 is laid along the spine or binding 23. The cover 20 is shown in the open position in FIG. 18. In this position, the binder 1 is bent away from the spine 23. In FIG. 19, the cover 20 is shown in the open position and some of the file sheets 2 are also in the open position. It will be noted that the file sheets can be turned over without any difficulty.

Figure 20:
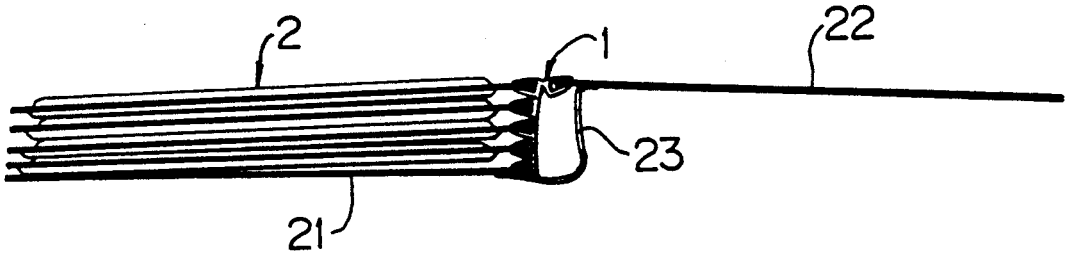
FIG. 20 is an end view showing a further embodiment of the present invention.

In the embodiment shown in FIGS. 15 through 19, the spine or binding 23 is of a relatively rigid structure. The spine 23 may be replaced by a flexible binding as shown in FIG. 20.

Figure 21:
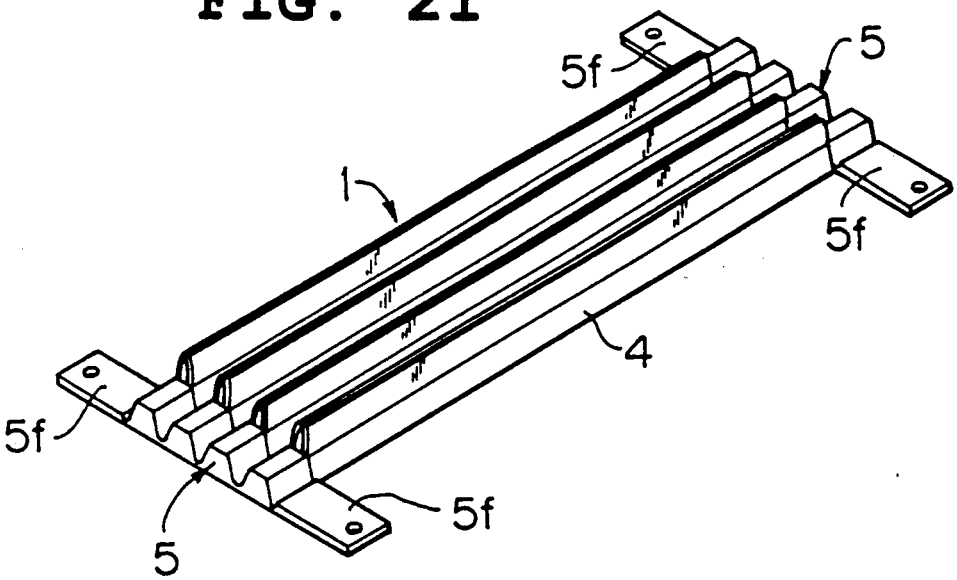
FIG. 21 is a perspective view of a binder in accordance with a further embodiment of the present invention; and, FIG. 22 is an end view of a file device using the binder shown in FIG. 21.
Figure 22:
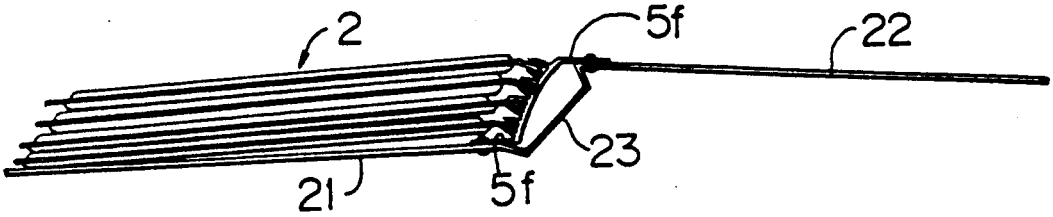

In FIG. 21, there is shown a further embodiment of the present invention. In this embodiment, the binder 1 is of a structure which is similar to that of the embodiment shown in FIG. 7. In this embodiment, however, the connecting member 5 is provided at the opposite sides with flexible bands 5*f*. The bands 5*f* are used to attach the binder 1 to the cover sheets 21 and 22 of the cover 20 as shown in FIG. 22.

From the above description, it will be understood that the present invention provides a filing device in which file sheets can readily be filed or removed. The binding member of the present invention allows to determine the capacity of the file as desired by adding or removing the binding member. Thus, the present invention provides a simple and compact file device.

The invention has thus been shown and described with reference to specific structures, however, it should be noted that the invention is in no way limited to the details of the illustrated structures but changes and modifications may be made without departing from the scope of the appended claims.

I claim:

1. A filing binder comprising a plurality of binding members made of a resilient material of a relatively rigid nature each having an elongated groove and a pair of opposed, inwardly directed edges which define a slit opening between said edges, said binding members being connected together at ends opposite to said slit openings by connecting means with said slit openings oriented in one direction, said connecting means including a plurality of projections arranged in side-by-side relationship, each of said projections being adapted for engagement with one of longitudinal ends of said groove of each said binding member, said connecting means being relatively flexible as compared to said binding members thereby permitting a hinge movement between any two adjacent binding members.

2. A file binder comprising a plurality of binding members as defined by claim 1 which are connected together at sides opposite to said slit openings through flexible connecting means, cover means including a spine provided outside said connecting means and a pair of cover sheets hinged to the opposite sides of said spine, said cover sheets being connected to the outermost ones of said plurality of binding members.

3. The filing binder of claim 1 wherein there is a gap between each adjacent binding member to further permit flexibility of the connecting means.

4. The filing binder of claim 1 wherein there is a longitudinally extending groove between each adjacent binding member to permit flexibility of the connecting means.

5. A combination of a file binder and at least one file sheet, said binder comprising a plurality of binding members made of a resilient material of a relatively rigid nature each being of an elongated configuration and having a pair of opposed, inwardly directed edges which define a slit opening between said edges, said binding members being connected at ends opposite to said slit openings together by connecting means with said slit openings oriented in one direction, said connecting means being relatively flexible as compared to said binding members thereby permitting a hinge movement between any two adjacent binding members, said file sheet having ridge means formed along at least one edge portion of said file sheet, whereby said file sheet can be filed in said binder by having said ridge means removably engaged with said slit opening of at least one of said binding members.

6. A filing device comprising a plurality of connecting members each comprising a pair of binding members, each binding member made of a resilient material and having an elongated groove and a pair of opposed, inwardly directed edges defining a longitudinally extending slit opening, each pair of binding members connected together by a flexible backing member, a plurality of file sheets each having a pair of ridge means formed along the opposite sides of said file sheet, a first file sheet being connected with a first connecting member by having one of the ridge means of a pair on said first file sheet engaged with said groove of one of the pair of binding members of said first member, a second file sheet being connected with said first one of said connecting members by having one of the ridge means of a pair on said second file sheet engaged with said groove of the other of the pair of binding members of said first one of said connecting members, the other ridge means of said pair on said second file sheet being connected with said groove in one of a pair of binding members in second one of said connecting members, a third file sheet being connected with said second one of said connecting members by having one of the ridge means of said pair on the third file sheet engaged with the groove in the other of the pair of binding members in said second one of said connecting members.

7. The filing device of claim 6 wherein each file sheet has two pairs of ridges formed along two opposed edges of the opposite sides of each sheet to provide versatility in the arrangement of the file sheets.

* * * * *